US005158119A

United States Patent [19]

Pezzoli et al.

[11] Patent Number: 5,158,119

[45] Date of Patent: Oct. 27, 1992

[54] SELVEDGE FORMING DEVICE FOR SHUTTLELESS LOOMS WITH LINEAR MOTOR CONTROL SYSTEM

[75] Inventors: Luigi Pezzoli, Leffe; Rossano Maffeo, Ranica, both of Italy

[73] Assignee: Vamatex S.p.A., Villa di Serio, Italy

[21] Appl. No.: 741,609

[22] Filed: Aug. 7, 1991

[30] Foreign Application Priority Data

Aug. 29, 1990 [IT] Italy ..... 21320 A/90

[51] Int. Cl.[5] ..... D03D 47/48

[52] U.S. Cl. ..... 139/434; 139/1 R

[58] Field of Search ..... 139/443, 444, 445, 22, 139/54, 135-140, 302, 430, 434, 1 R

[56] References Cited

U.S. PATENT DOCUMENTS 4,909,283 3/1990 Verclyte ..... 139/434
4,943,927 7/1990 Yarita et al. ..... 139/1 R

FOREIGN PATENT DOCUMENTS 0286443 10/1988 European Pat. Off. .
3118723 1/1983 Fed. Rep. of Germany ..... 139/434
2-112446 4/1990 Japan .

*Primary Examiner*—Andrew M. Falik
*Attorney, Agent, or Firm*—Young & Thompson

[57] ABSTRACT

A device to form the selvedge in shuttleless looms, includes a weft yarn gripping member, a first shaft reciprocable lengthwise to operate the weft yarn gripping member, a first linear electric motor to reciprocate the first shaft, a cutting member for cutting weft yarn gripped by the gripping member, a second shaft reciprocable lengthwise to actuate the cutting member, and a second linear electric motor for reciprocating the second shaft. A yarn engaging hook is carried by a needle to insert weft tails cut off by the cutting member, into a strip of warp yarns, thereby to form a selvedge. A third shaft carries the needle, from which said needle extends transversely. A third linear electric motor reciprocates the third shaft lengthwise. A sensor senses the reciprocated position of the third shaft thereby to control the third linear electric motor. A fourth linear electric motor rotates the third shaft. Another sensor senses the rotated position of the third shaft thereby to control the fourth linear electric motor. A microprocessor receives input from sensors and controls the operation of the motors and continuously varies the operation of the device.

1 Claim, 1 Drawing Sheet

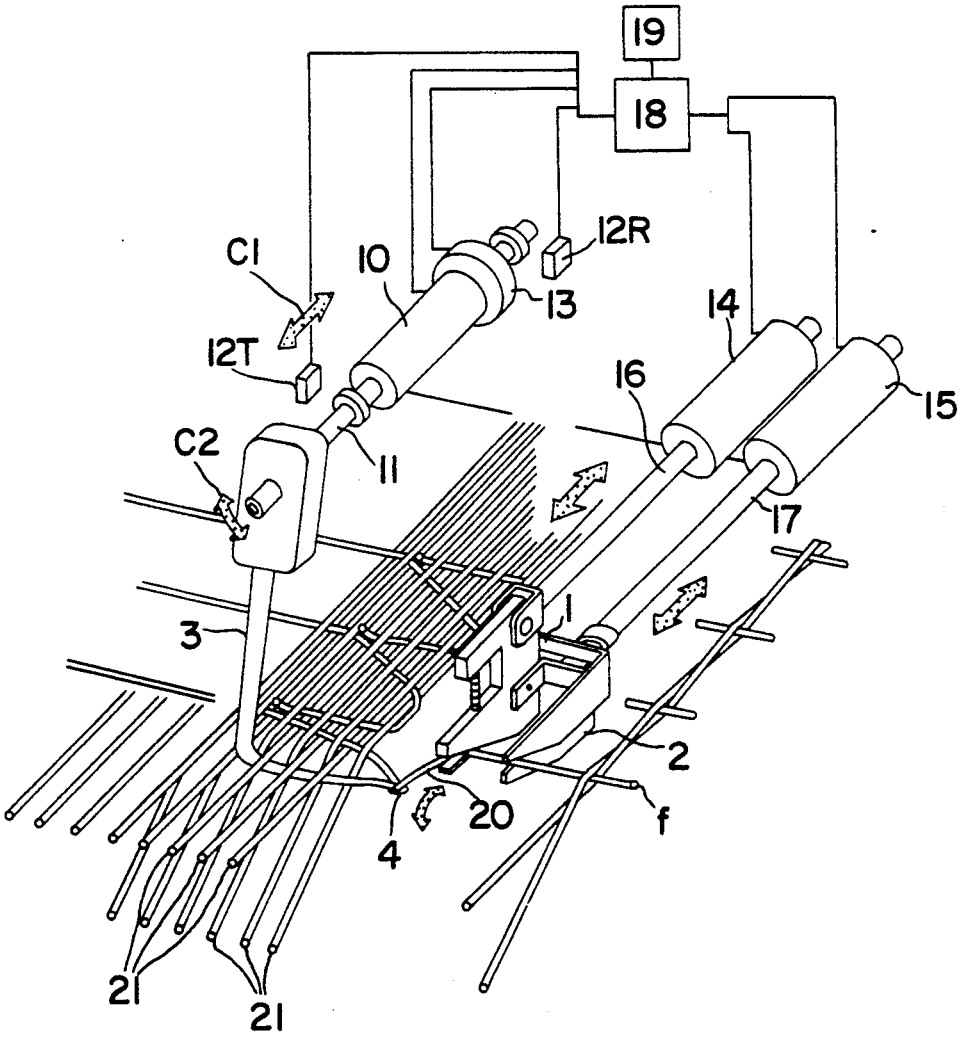
19
18
12R
C1
10
13
14
12T
16
15
C2
11
17
1
3
2
20
f
4
21
21

SELVEDGE FORMING DEVICE FOR SHUTTLELESS LOOMS WITH LINEAR MOTOR CONTROL SYSTEM

BACKGROUND OF THE INVENTION

1. Field of the Invention

The present invention concerns an improved device to form the selvedge in shuttleless looms.

It is known that, in any type of such looms, suitable transport means (such as shuttles grippers, projectiles, air or water means) insert an appropriate sequence of weft yarns into the sequence of warp yarns forming the shed.

In the case of shuttle looms, the warp yarns at the edges of the fabric, forming the so-called selvedge, are woven by the same weft which repeatedly moves into and out of the warp shed, after said warp yarns have exchanged their position, so as to obtain the wanted weave.

As is known, such fabrics are characterized by even edges, which stand particularly well any subsequent finishing and printing treatments.

In shuttleless looms (gripper, projectile, fluid jet, air and water looms) it is not possible to obtain the same selvedge which can be formed with shuttle looms. On the other hand, to form a sufficiently strong and even selvedge, special devices have to be used, which weave together the outer warp yarns and the inserted weft yarns.

2. Description of the Prior Art

Among the different devices already used for this purpose, there are known to be mechanical devices called "tuck-in selvedge devices".

These devices allow a succession of co-ordinated movements to be performed by mechanical members, in order to carry out the following operations:

1) A mechanically or pneumatically controlled gripping member (for instance a gripper) seizes the weft yarn which has just been inserted after the reed has started its opening movement.

2) A cutting member, such as a shear, cuts the weft yarn just seized by the gripper at a suitable distance from the edge of the fabric.

3) A needle performs a translatory and rotary motion, inserting its hook-shaped tip into a proper position of the warp shed, and then moves back towards the gripper separating a suitably wide strip of warp yarns.

4) The gripper winds the weft yarn around the hook-shaped needle tip.

5) The needle, with a rotary movement, inserts the weft tail, cut to size, into the strip of warp yarns.

Fabric selvedges thus formed look like those which can be obtained with shuttle looms; the edges are hence even and strong.

The tuck-in selvedge devices used on currently known shuttleless looms provide for the aforecited members to be moved mechanically, by lever and/or cam kinematic mechanisms, or else pneumatically.

Particularly in shuttleless looms for terry cloth weaving—both in the case of shifting the reed beat-up point and in the case of shifting the fabric—the wefts to be tucked in during the loop forming cycle, which can last three or four weft insertions, are at different distances in respect of the selvedge forming device.

In order to obtain the tuck-in of the weft, it would hence be necessary to be able to suitably vary cyclically the longitudinal stroke of the needle or else, keeping the needle stroke fixed, to perform the tuck-in at different times of the loom working cycle, in correspondence of which times the weft is at the weft is at the same distance from the tuck-in device.

It should also be noted that in terry cloth weaving looms, besides the aforementioned weaving to form the loop, other weavings are performed which could require weft tuck-in after each weft insertion, and in which the weft is at the same distance from the device. In such cases, no change in the longitudinal stroke of the needle is hence required.

The currently known selvedge forming devices do not allow to obtain the above desired performances, in that it is not possible to continuously vary, in devices making use of mechanical elements like cams and levers, the strokes and phases of the needle and gripper motion during operation.

A known solution, allowing to partly overcome the problem, is to tuck in the weft—also with the possibility of selection—after a number of wefts has been inserted, to which there corresponds—for the type of weaving being performed—an equal position of the weft in resect of the device and thus in respect of the needle. Usually, in terry cloth weaving looms, this takes place at the end of the beat-up forming the loop. Such devices therefore realize the simultaneous tuck-in of three or four weft tails in the terry cloth weave, which can cause shear cutting problems or require a needle with a large hook.

SUMMARY OF THE INVENTION

All these drawbacks are fully overcome by the tuck-in selvedge forming device of the present invention, which is characterized in that the operation of the mechanical members performing the various functions allowing to tuck in the weft tail, is at least partly obtained by means of linear electric permanent magnet or induction motors—having small inertias and masses in respect of the forces obtained—each comprising a detection device or sensor adapted to detect with precision and continuity the position of the operated member, said motors being controlled by a microprocessor connected to the loom control system, which coordinates the different movements of said motors with variable working strokes, so as to obtain the tuck-in of the weft tail in a freely programmable way.

BRIEF DESCRIPTION OF THE DRAWING

The drawing is a perspective view of the selvedge forming device according to the invention.

DESCRIPTION OF THE PREFERRED EMBODIMENT

With reference to the drawing, the device according to the invention comprises—in known manner—a gripper 1 to seize the weft yarn f, a shear 2 to cut said weft yarn, and a movable element to tuck in the weft yarn, consisting of a needle 3 having at the end a yarn engagement hook 4.

According to the invention, a linear electric motor 10 (a permanent magnet or induction motor) imparts rectilinear movements C1 in both directions to the needle 3 with hook 4. The needle 3 is keyed onto a shaft 11, of reduced mass, of the motor 10 which is also equipped with a position sensor 12T adapted to detect the position of the shaft 11 in its rectilinear movement. A linear electric rotary motor 13 (a permanent magnet or induction motor) causes—either simultaneously or independently from the previous one—the rotation C2 in both directions of the same needle 3 with hook 4. A sensor 12R detects the position of the shaft 11 in its rotational movement. Two further linear electric motors 14 and 15 (permanent magnet or induction motors) impart rectilinear alternating movements to the gripper 1 and to the shear 2; also these motors 14 and 15 are equipped with sensors (not shown) adapted to detect the position of their respective shafts 16 and 17.

Furthermore a microprocessor 18, which processes the data supplied by the loom (from 19) and by the position sensors, controls the motors 10, 13, 14 and 15, so as to tuck in the weft according to the cycles programmed to form the selvedge, which is formed—as already indicated—thanks to the gripper 1 seizing the weft f, the shear 2 cutting the weft tails to the wanted size, and the needle 3 with hook 4 inserting the cut tails 20 into the strip of warp yarns 21.

The device according to the invention provides considerable advantages in respect of the already known mechanical devices, while overcoming their drawbacks. It in fact allows to modify the motion of the needle 3 and/or of the shear 2 and/or of the gripper 1, with reference to the strokes and times of their movements, by way of a special programming (to be carried out with suitable software), sending the requested input to the microprocessor 18 of the device.

This allows to advantageously use the invention especially on terry clothe weaving looms. In fact, a selvedge forming device constructed in this way allows to tuck in the weft also in the intermediate beat-up phases forming the loop, by varying the stroke or the times of the needle motion to obtain this, one simply has to supply the data of the requested strokes and times via software.

It is hence also possible to tuck in thick wefts at each insertion, improving the look and quality of the selvedge thus obtained.

The device requires no mechanical drive from the loom, whereby the positioning of the motor shafts is not conditioned by that of the drive.

The position sensors can promptly detect any working faults and the microprocessor can stop the motors from running, so as to prevent any mechanical impacts between the needle, and/or the gripper and shear, and the reed, subsequently signalling to the user that the loom has stopped.

The device is of compact structure and easy to position on the loom. The hook-needle element can be positioned in any direction in respect of the longitudinal axis of the loom and in respect of that of the gripper and of the shear, with obvious advantages of structural simplicity and convenience, as well as saving of space.

It is to be understood that there can be further practical embodiments of the invention, other than that described and illustrated, which fully fall within the protection scope thereof.

We claim:

1. A device to form the selvedge in shuttleless looms, said device comprising a weft yarn gripping member, a first shaft reciprocable lengthwise to operate said weft yarn gripping member, a first linear electric motor to reciprocate said shaft, a cutting member for cutting weft yarn gripped by said gripping member, a second shaft reciprocable lengthwise to actuate said cutting member, a second linear electric motor for reciprocating said second shaft, a yarn engaging hook carried by a needle to insert weft tails cut off by said cutting member, into a strip of warp yarns, thereby to form a selvedge, a third shaft carrying said needle and from which said needle extends transversely, a third linear electric motor to reciprocate said third shaft lengthwise, means to sense the reciprocated position of said third shaft thereby to control said third linear electric motor, a fourth linear electric motor to rotate said third shaft, means to sense the rotated position of said third shaft thereby to control said fourth linear electric motor, and a microprocessor that receives input from said sensing means and that controls the operation of said motors and continuously varies the operation of said device.

* * * * *